US008172317B2

(12) United States Patent
Gamboa

(10) Patent No.: US 8,172,317 B2
(45) Date of Patent: May 8, 2012

(54) STACKABLE CHAIR

(76) Inventor: Gustavo G. Gamboa, Tinley Park, IL (US)

( * ) Notice: Subject to any disclaimer, the term of this patent is extended or adjusted under 35 U.S.C. 154(b) by 0 days.

(21) Appl. No.: 13/179,734

(22) Filed: Jul. 11, 2011

(65) Prior Publication Data

US 2011/0266843 A1 Nov. 3, 2011

Related U.S. Application Data

(63) Continuation-in-part of application No. 13/171,709, filed on Jun. 29, 2011, which is a continuation-in-part of application No. 12/639,511, filed on Dec. 16, 2009.

(60) Provisional application No. 61/275,189, filed on Aug. 26, 2009.

(51) Int. Cl.
*A47C 7/68* (2006.01)

(52) U.S. Cl. ..... 297/188.14; 297/239; 297/451.12

(58) Field of Classification Search ..... 297/188.14, 297/239, 451.11, 451.12
See application file for complete search history.

(56) References Cited

U.S. PATENT DOCUMENTS

| | | | | |
|---|---|---|---|---|
| 3,233,940 | A * | 2/1966 | Tooley, Jr. | 297/188.18 |
| 4,798,413 | A * | 1/1989 | Capelli | 297/161 |
| D361,915 | S * | 9/1995 | Zinnbauer | D6/501 |
| 5,641,197 | A * | 6/1997 | Springmann | 297/188.11 |
| 6,059,357 | A * | 5/2000 | Peart | 297/173 |
| 6,439,659 | B1 * | 8/2002 | Neubauer, Jr. | 297/188.01 |
| 6,840,574 | B1 * | 1/2005 | Wu | 297/45 |
| 7,243,991 | B2 * | 7/2007 | Ojeda | 297/188.14 |
| 7,530,632 | B2 * | 5/2009 | Kaloustian et al. | 297/188.14 |
| 2006/0138814 | A1 * | 6/2006 | Burbrink | 297/188.14 |
| 2010/0301644 | A1 * | 12/2010 | Adams et al. | 297/183.1 |

* cited by examiner

*Primary Examiner* — Peter R. Brown
(74) *Attorney, Agent, or Firm* — Schiff Hardin LLP

(57) ABSTRACT

In a stackable chair system, a plurality of chairs are provided, each chair having a back, a seat, and first and second armrests all integral with one another in an injection-molded thermal plastic construction. Each first armrest has an integral molded round cup-holder positioned in a region of an outer end of the first armrest. Each second armrest has an integral molded plate-holder or an integral molded second round cup-holder positioned in a region of an outer end of the second armrest. Each seat is contoured downwardly forming a seat depression. Each chair is dimensioned so that the chairs can be stacked on top of one another in nested fashion.

24 Claims, 4 Drawing Sheets

STACKABLE CHAIR

RELATED APPLICATION

The present application is a continuation-in-part of U.S. patent application titled: "Stackable Chair," U.S. Ser. No. 13/171,709 filed Jun. 29, 2011, inventor Gustavo G. Gamboa, which is a continuation-in-part of U.S. patent application titled: "Stackable Chair," U.S. Ser. No. 12/639,511 filed Dec. 16, 2009, inventor Gustavo G. Gamboa, which claims the benefit of the filing date of U.S. provisional patent application titled: "Stackable Chair," Ser. No. 61/275,189 filed Aug. 26, 2009, inventor Gustavo G. Gamboa.

BACKGROUND

The preferred embodiments relate generally to a stackable chair.

Inexpensive, molded plastic lawn or patio chairs are used for outdoor events and gatherings. These stackable, one-piece chairs have become standard equipment for consumer households as well as a wide variety of organizations, institutions, and establishments ranging from bars and caterers to schools and churches. The molded stackable chairs are lightweight and inexpensive, easy to move and store, and quite durable for the price. But, when used for events at which food and drink are served and consumed, the standard design of such chairs comes up short. Attempting to enjoy a plate of barbecue and a soft drink while sitting in such a chair, the guest must hold the plate in his or her lap, and either hold the drink or set it on the ground. As a result, drinks and plates get spilled, guests' clothing gets soiled, and the entire event becomes less enjoyable than it might have been.

SUMMARY

In a stackable chair system, a plurality of chairs are provided, each chair having a back, a seat, and first and second armrests all integral with one another in an injection-molded thermal plastic construction. Each first armrest has an integral molded round first cup-holder positioned in a region of an outer end of the first armrest. Each second armrest has an integral molded plate-holder or an integral molded second round cup-holder positioned in a region of an outer end of the second armrest. Each seat is contoured downwardly forming a seat depression. Each chair is dimensioned so that the chairs can be stacked on top of one another in nested fashion.

DESCRIPTION OF THE PREFERRED EMBODIMENTS

Figure 2A:
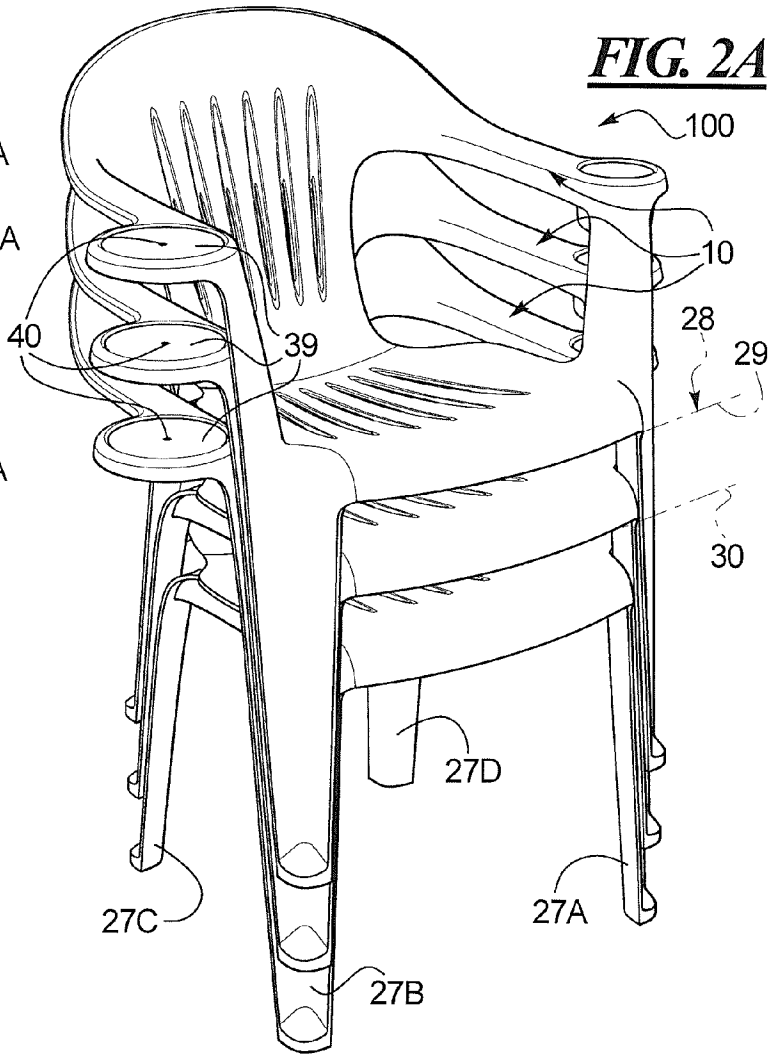
FIG. 2A is a perspective view of a stack of the stackable chairs according to the preferred embodiment of FIG. 1.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Figure 1:
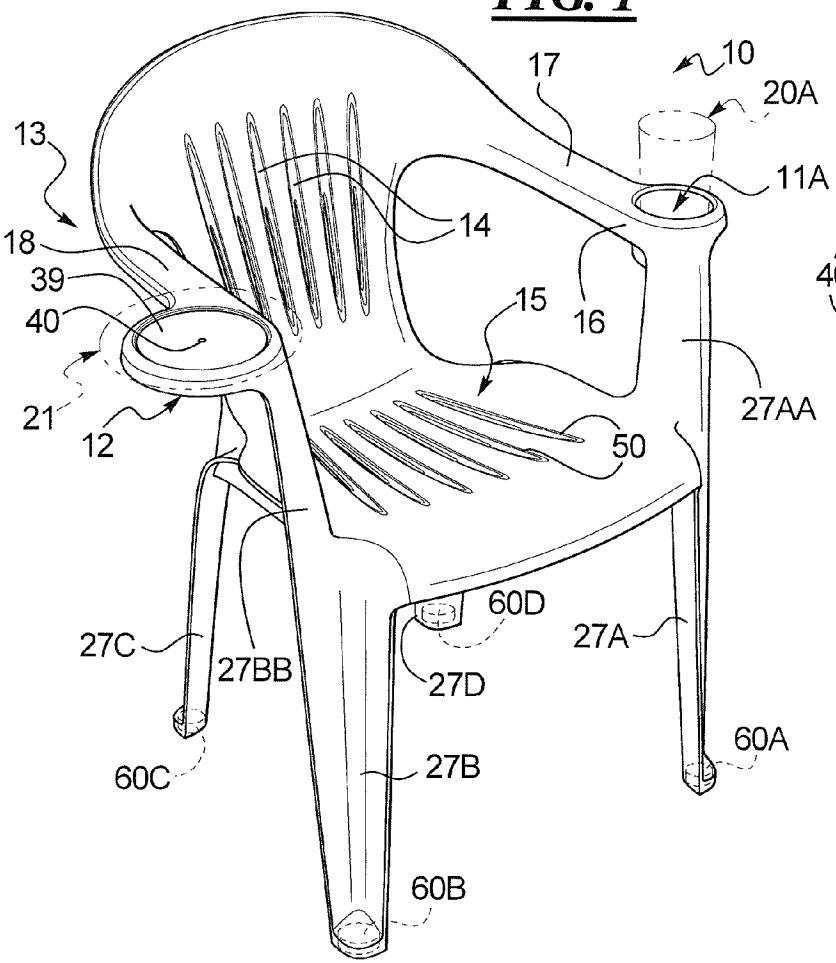
FIG. 1 is a perspective view illustrating a stackable chair, constructed in accordance with a preferred embodiment.
Figure 2B:
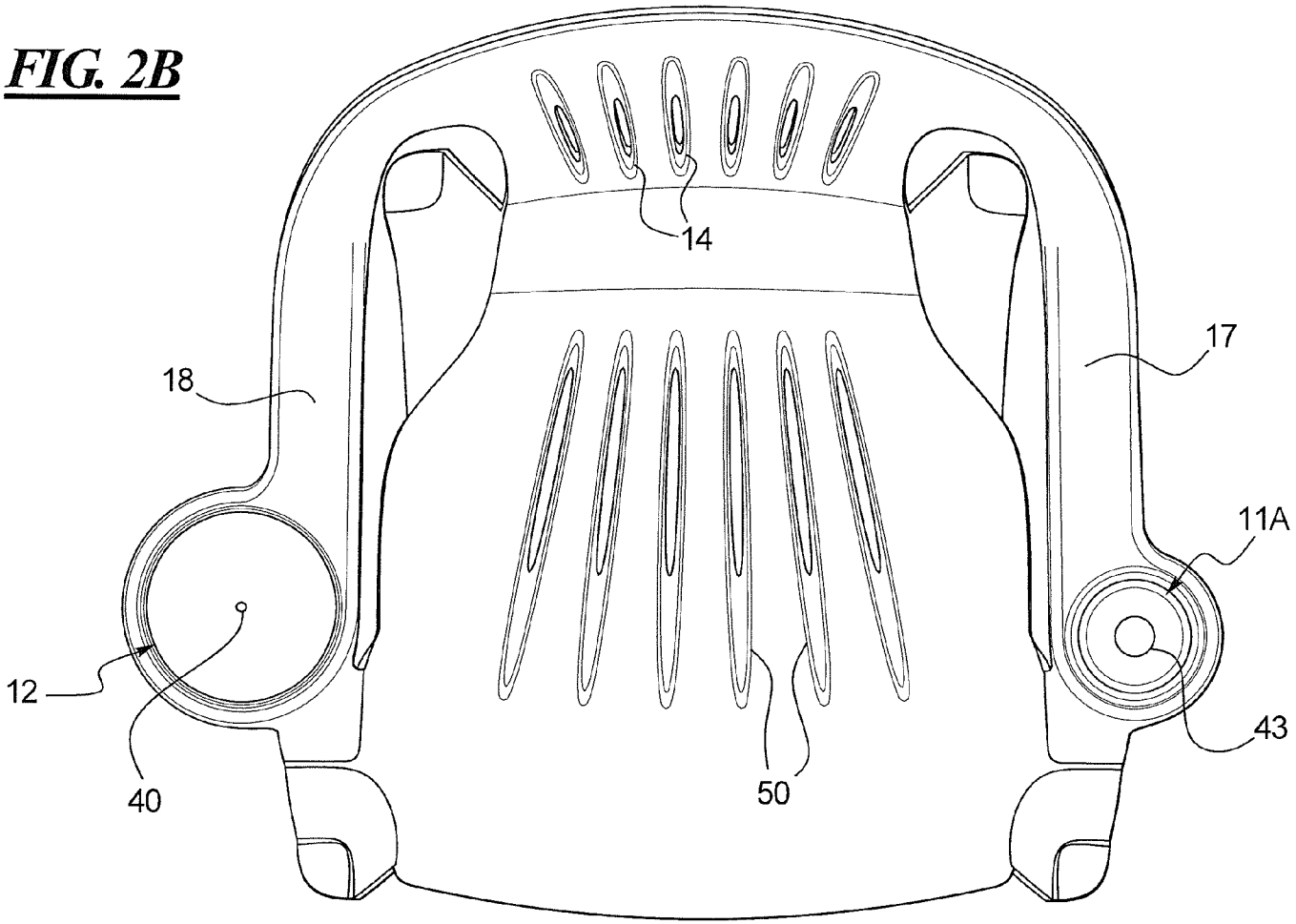
FIG. 2B is a top view of the stackable chair of FIG. 1.

As illustrated in FIG. 1, the present preferred embodiment is a stackable chair for greater versatility.

As more particularly shown in FIG. 1, the stackable chair 10 of the present preferred embodiment is a one-piece, molded plastic, stackable upright patio or lawn chair, similar in design and construction to those found in common use throughout the country, but incorporating design features making the chair unique and far more useful and versatile than the standard chair. The stackable chair 10 features a molded beverage or cup-holder 11A built into the left-hand armrest 17 for receiving a cup 20A and a plate-holder 12 built into the right-hand armrest 18 for holding a plate 21.

The stackable chair 10 of the present preferred embodiment is approximately three (3') feet in height, with a width of approximately two (2') feet and a depth of approximately two (2') feet; a one-piece, injection-molded thermoplastic construction which is weatherproof and UV-resistant, sturdy and durable; a rounded or angular chair back 13 with stylish slats 14, and a contoured, comfortable seat 15, also with slats 50. At the end 16 of the left armrest 17, the stackable chair features the cup-holder 11A which is at least two (2") inches but which may be up to four and one-half (4½") inches in depth, with a width of at least two inches (2") and preferably about three (3") inches, and designated to hold a beer or soft-drink bottle or can, or a Styrofoam or plastic picnic cup 20A.

The chair's right armrest 18 has the molded plate-holder 12 which is at least four (4") inches but preferably six (6") inches in diameter, and has a flat recessed floor 39 having a depth of at least one-sixteenth (1/16") inch for accommodating and securing a paper, plastic, or Styrofoam picnic plate 21. The plate-holder is at the end of the right armrest and a portion of its outer peripheral edge forms the outer end of the armrest.

The cup-holders 11A and the plate-holder 12 are positioned laterally toward the outer sides of the two armrests. The cup-holder 11A and the plate-holder 12 are both separate from respective front legs 27A and 27B, respectively, and more particularly are separate from upper portions 27AA and 27BB of these legs where they continue up and connect with the respective arm rests 17 and 18.

Figures 3, 4, 5, 6, 7:
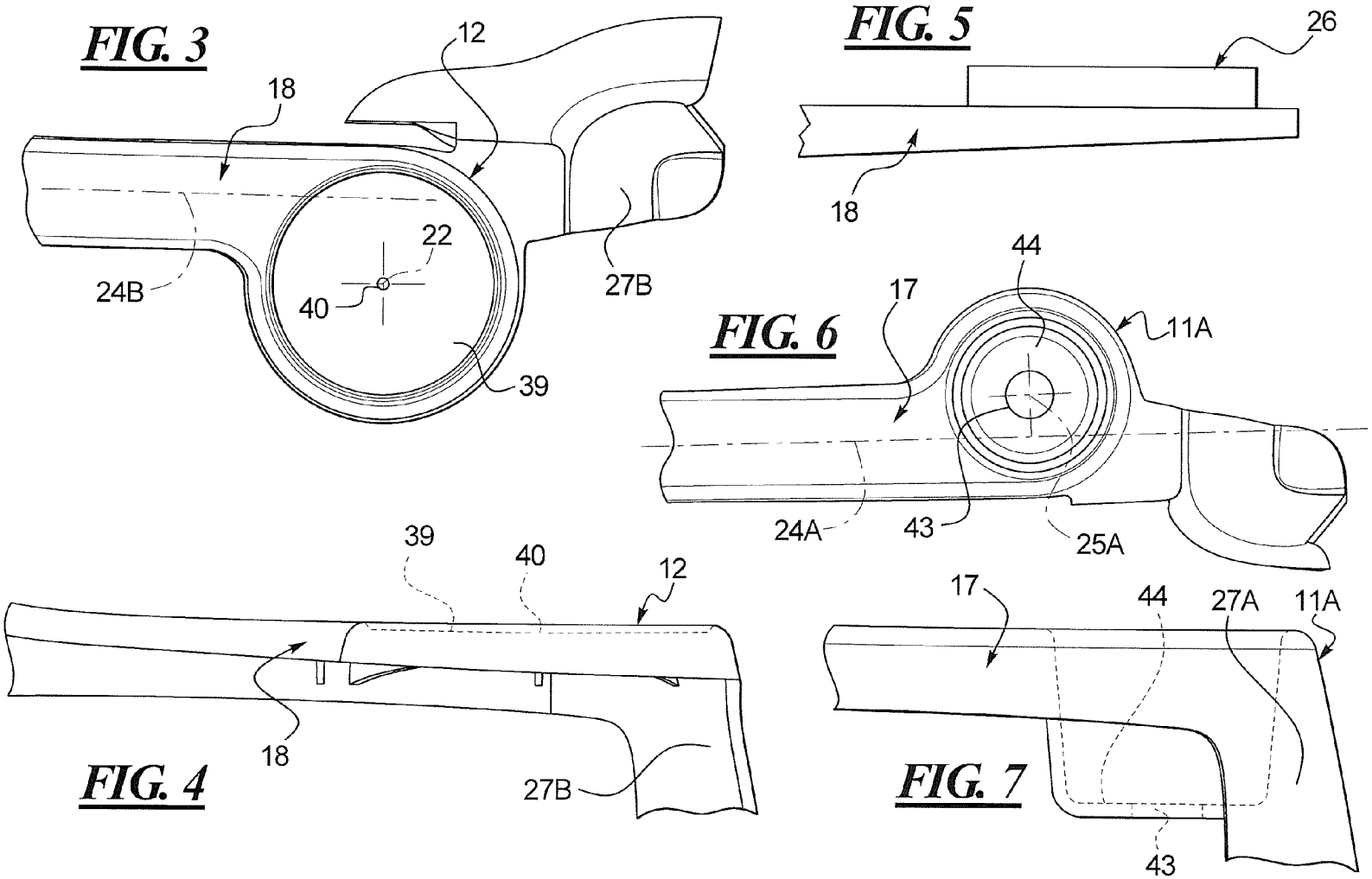
FIG. 3 is a top partial view of the plate-holder in FIG. 1.
FIG. 4 is a side partial view of the plate-holder of FIG. 1.
FIG. 5 is a side partial view of an alternative plate-holder.
FIG. 6 is a top partial view of the cup-holder in FIG. 1.
FIG. 7 is a side partial view of the cup-holder of FIG. 1.

As to the plate-holder 12, when viewed from the top as shown in FIG. 3, it may be observed that the central vertical axis 22 of the plate-holder 12 is outwardly of the longitudinal center line 24B of the armrest 18 by at least one-half inch (½") and preferably approximately one inch (1"). And as to the cup-holder 11A, as shown in FIG. 6, with respect to a longitudinal center line 24A of the armrest 17, a central vertical axis 25A of the cup-holder 11A is outwardly offset by at least one-half (½") inch from the longitudinal center line 24A.

The floor 39 of the plate-holder 12 has a rain water drain hole 40. Similarly the cup-holder 11A has a rain water drain hole 43 in the floor 44.

Alternatively, as shown in the side view of FIG. 5, the plate-holder may be a planar disc 26 as illustrated. It may have a diameter of at least four inches (4") but preferably six inches (6").

FIG. 4 is a side partial view of the plate-holder 12 of FIGS. 1 and 3.

FIG. 7 is a side partial view of the beverage holder 11A of FIGS. 1 and 6.

The stackable chair can be produced in a variety of colors and finishes to suit the range of consumer taste.

As shown in FIG. 2A, the stackable chair 10 is shaped and dimensioned to be stackable to form a stack 100 for storage and transport, each chair nesting easily and securely atop the chair beneath it. For stacking, the rear legs 27C, 27D pass through a gap between the respective arm rests 17, 18 and lateral side edges of the seat 15. When vertically stacked, the legs 27A, 27B, 27C, 27D move along and outwardly of the previous stacked chair legs. Furthermore, since each of the chair legs 27A, 27B, 27C, 27D has an angled cross-section the resulting groove guides the chairs during stacking.

Each of the chair legs 27A, 27B, 27C, 27D has rubber feet 60A, 60B, 60C, 60D inserted therein for gripping and protection of the ends of the chair legs.

The seat 15 also has stylish slats 50 similar to the slats 14 in the rear back of the chair.

Preferably the stackable chair 10 is dimensioned so that when stacked, there is gap 28 between the front lower edge 29 of the upper adjacent chair and front upper edge 30 of the lower adjacent chair of no more than four inches (4") and preferably of about two inches (2").

Figure 9:
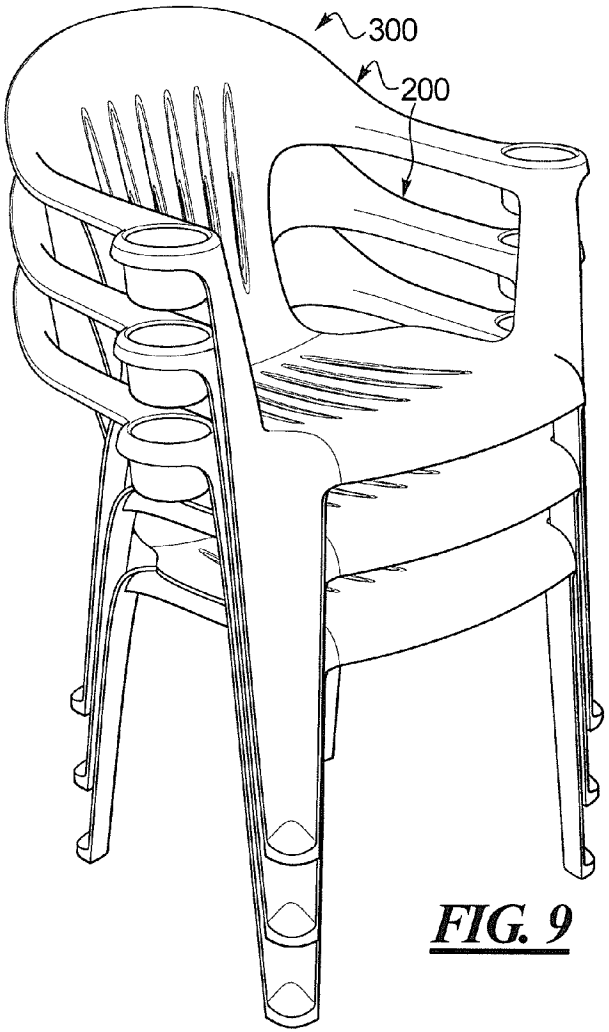
FIG. 9 is a perspective view of a stack of the stackable chairs according to the another embodiment of FIG. 8.
Figure 8:
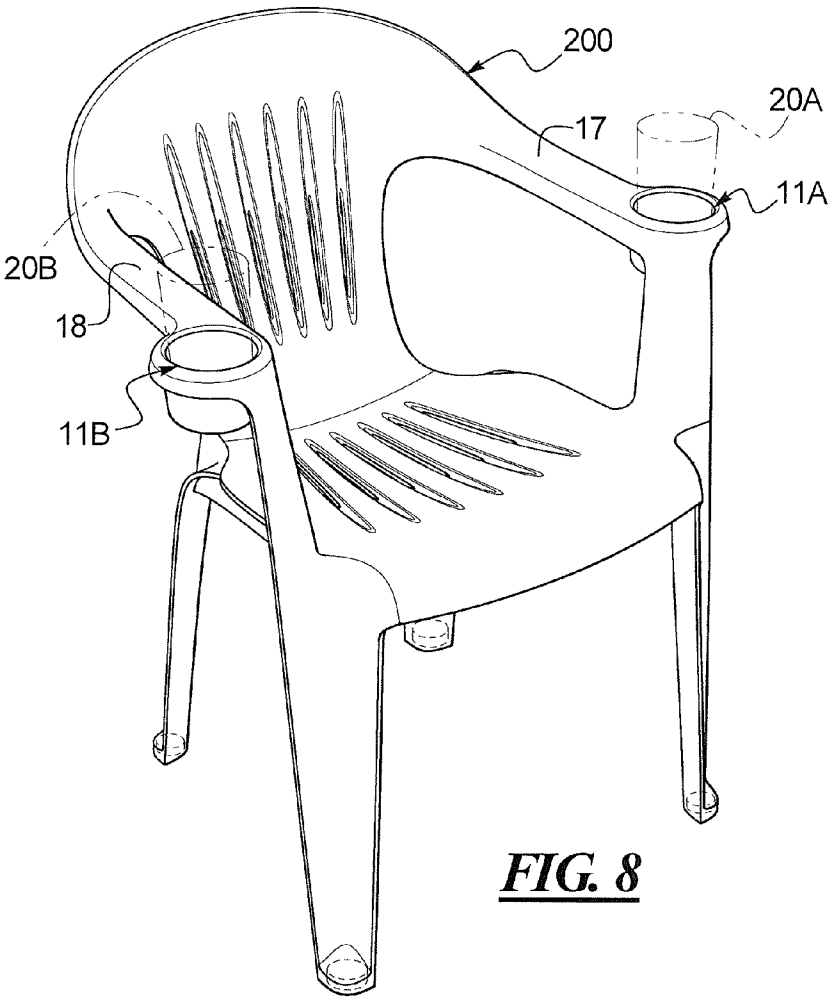
FIG. 8 is a perspective view illustrating another embodiment of a stackable chair.

In an alternate embodiment shown in FIG. 8, a chair 200 similar to that shown in FIG. 1 is provided. However, instead of a plate-holder in the right armrest 18 a second cup-holder 11B is provided identical to the cup-holder 11A previously described but located in mirror symmetric fashion in the right hand armrest 18 and thus extends outwardly to the right whereas the first cup-holder 11A extends outwardly to the left. Stacking of the chair 200 is shown in FIG. 9 at 300.

A cup 20B may be received in the second cup-holder 11B so that two cups are held—namely the cup 20A in the first cup-holder 11A and cup 20B in the second cup-holder 11B. The cups 20A and 20B could be different cups or the same cup placed in the second cup-holder 11B instead of the first cup-holder 11A.

The upper portion of the legs 27A and 27B at 27AA and 27BB is also angled in cross-section forming a groove, and the downward extension of the cup-holder 11A for FIG. 1 or 11A and 11B for FIG. 7 has a periphery portion facing toward the angled groove in the upper leg portions 27AA or 27BB. respectively.

The stackable chair 10 of the present preferred embodiment, which is a one-piece, molded plastic patio or lawn chair in which the armrests 17 and 18 have been designed to hold the disposable cup 20A and plate 21, or the additional cup 20B in the case of the alternate embodiment, presents a number of distinct and significant benefits and advantages. Foremost, the stackable chair 10 offers the same convenience, ease of storage and transport, and minimal expense that have made one-piece, molded plastic outdoor chairs so popular. But the drawback with all such chairs currently on the market, i.e., the lack of a place for food and drink, has been overcome with the design of the stackable chair. The chair does, in fact, hold everything that the outdoor sitter might need at a cook-out or barbecue, a community concert, or a firehouse or church supper because the chair gives the sitter a secure, ample cup-, can-, or bottle-holder 11A in the left armrest 17 for the cup 20A (or cup-holder 11B for the cup 20B in the alternate embodiment); and the secure holder 12 for the paper or plastic picnic plate 21 in the right armrest 18. The chair 10 not only provides a secure place for food and drink, but also is also stackable, for the convenient storage and transport qualities that have made one-piece molded chairs such a favorite. For household consumers, for catering companies, for bars and restaurants with outside seating, for church and community groups, schools, concert venues, the chair will appeal strongly, and very likely become the standard in affordable, stackable, outdoor seating.

The foregoing exemplary descriptions and the illustrative preferred embodiments of the present invention have been explained in the drawings and described in detail, with varying modifications and alternative embodiments being possible. While the invention has been so shown, described and illustrated, it should be understood by those skilled in the art that equivalent changes in form and detail may be made therein without departing from the true spirit and scope of the invention, and that the scope of the present invention. Moreover, the invention as disclosed herein, may be suitably practiced in the absence of the specific elements which are disclosed herein.

I claim as my invention:

1. A stackable chair system, comprising:

a plurality of chairs, each chair having a back, four legs, a seat, and first and second armrests all integral with one another in an injection-molded thermal plastic construction;

each first armrest having an integral molded first round non-movable cup-holder positioned in a region of an outer end of the first armrest;

each second armrest having an integral molded non-movable plate-holder or an integral molded second round non-movable cup-holder positioned in a region of an outer end of the second armrest;

the back, seat, four legs, first and second armrests, first cup-holder, and plate-holder or second cup-holder all being an integral single molded piece;

each seat portion being contoured downwardly forming a seat depression;

each chair being shaped and dimensioned so that the chairs can be stacked on top of one another in nested fashion;

the first cup-holder being located at an end of the first armrest and outwardly of an upper portion of a respective front leg of said four legs joining to the first armrest at the end of the first armrest and wherein the upper portion has an angled smoothly rounded concave cross-section, and wherein said smoothly rounded concave cross-section substantially conforms to a portion of an outer diameter of the first round cup-holder; and the plate-holder or the second cup-holder being located at an end of the second arm rest and outwardly of an upper portion of a respective front leg joining to the second arm rest at the end of the second arm rest and wherein the upper portion has an angled smoothly rounded concave cross-section.

2. The system of claim 1 wherein the first armrest is a left armrest and the second armrest is a right armrest.

3. The system of claim 1 wherein said second armrest has said plate-holder, a portion of an outer periphery of said plate-holder forms an end of the second armrest and the plate-holder has a central vertical axis which is outwardly of a longitudinal center line of the second armrest.

4. The system of claim 1 wherein said second armrest has said plate-holder, and the plate-holder has a flat, recessed floor.

5. The system of claim 1 wherein said second armrest has said plate-holder, and the plate-holder is a flat, round integral disc.

6. The system of claim 1 wherein said second armrest has said plate-holder, and the plate-holder is round.

7. The system of claim 1 wherein said second armrest has said second cup-holder, and the first and second cup-holders are integrally molded at an end of the respective first and second armrests.

8. The system of claim 7 wherein the first and second cup-holders have an outer periphery, a portion of which forms an end of the respective first and second armrests, and wherein an upper portion of respective left and right front legs merges into the end of the respective armrest, each upper portion having an angled cross-section forming a groove adjacent to a downwardly extending portion of each of the first and second cup-holders.

9. The system of claim 1 wherein said second armrest has said second cup-holder, and a respective central vertical axis of the respective cup-holder is positioned outwardly of a respective longitudinal center line of the first and second armrests.

10. The system of claim 9 wherein said respective central vertical axis is at least one-half (½") inch outwardly of said respective longitudinal center line of said respective first and second armrests.

11. The system of claim 1 wherein each chair comprises a weather-proof, UV-resistant material.

12. The system of claim 1 wherein said chairs are dimensioned so that when they are stacked there is a gap between a front of each seat of adjacent chairs of no more than 4 inches.

13. The system of claim 1 wherein said chairs are dimensioned so that when they are stacked there is a gap between a front of each seat of adjacent chairs of no more than 4 inches.

14. The system of claim 1 wherein the chairs each have two front legs and two back legs, the legs all having an angled cross-section forming respective grooves so that when stacked the grooves comprise respective guide surfaces for legs of the chairs being stacked on top of one another.

15. The system of claim 1 wherein each of the chairs has two front legs and two rear legs and the ends of the legs have rubber caps attached thereto.

16. The system of claim 1 wherein the second armrest has said plate-holder, and the plate-holder has an aperture in a recessed floor thereof for drainage and the cup-holder also has a recess in a bottom thereof for drainage.

17. A stackable chair system, comprising:

a plurality of chairs, each chair having a back, a seat, four legs, and left and right armrests all integral with one another in an injection-molded thermal plastic construction;

each left armrest has an integral molded first round non-movable cup-holder for accommodating a cup and is at least 2 inches in depth and positioned such that a central vertical axis of the cup lies at least ½ inch outwardly of a longitudinal center line of the left armrest;

each right armrest has an integral molded non-movable plate-holder for accommodating a plate, or an integral molded second round non-movable cup-holder for accommodating a cup and which is at least 2 inches in depth, the plate-holder or the cup-holder being positioned such that a central vertical axis thereof lies at least ½ inch outwardly of a longitudinal center line of the right armrest;

the back, seat, four legs, first and second armrests, first cup-holder, and plate-holder or second cup-holder all being an integral single molded piece;

each seat being contoured downwardly forming a seat depression;

each chair being dimensioned so that the chairs can be stacked on top of one another in nested fashion such that rear legs of said four legs pass through a gap between the respective armrest and a respective outer lateral edge of the seat, and wherein a maximum gap between a front of each seat of adjacent chairs when stacked is no greater than four inches; and the plate-holder or the first and second cup-holders being located at an end of the respective armrest and outwardly of an upper portion of a respective front leg of said four legs joining to the armrest at the end of the armrest and wherein the upper portion has an angled smoothly rounded concave cross-section, said smoothly rounded concave cross-section at the left armrest substantially conforming to a portion of an outer diameter of the first round cup-holder, and wherein the front legs and the rear legs have angled cross-sections forming respective grooves permitting sliding of the legs over one another during stacking.

18. A stackable chair system, comprising:

a plurality of chairs, each chair having a back, a seat, and first and second armrests all integral with one another in an injection-molded thermal plastic construction;

each first armrest having an integral molded first round cup-holder positioned in a region of an outer end of the first armrest;

each second armrest having an integral molded plate-holder positioned in a region of an outer end of the second armrest;

each seat portion being contoured downwardly forming a seat depression;

each chair being shaped and dimensioned so that the chairs can be stacked on top of one another in nested fashion;

a portion of an outer periphery of said plate-holder forms an end of the second armrest and the plate-holder has a central vertical axis which is outwardly of a longitudinal center line of the second armrest; and said portion of said outer periphery of said plate-holder at said end of the second armrest merges into an upper portion of a front leg of the chair and said upper portion has an angled smoothly rounded concave cross-section forming a groove adjacent to a round recessed floor of the plate-holder, said concave cross-section substantially conforming to a portion of an outer diameter of the round recessed floor.

19. The system of claim 18 wherein said second armrest has said plate-holder, and the round plate-holder is provided at an outer end of the right armrest and integrally molded thereto and has a recessed flat floor having a depth of at least approximately one-sixteenth (1/16") inch for accommodating a food plate.

20. The system of claim 18 wherein said second armrest has said plate-holder, and the plate-holder has a rain water drain hole in a flat floor thereof.

21. The system of claim 18 wherein said second armrest has said second cup-holder, and the first and second cup-holders each have a floor with a respective rain water drain hole therein.

22. A stackable chair system, comprising:

a plurality of chairs, each chair having a back, a seat, four legs, and two armrests all integral with one another in an injection-molded thermal plastic construction;

at least one of the armrests of each chair having an integral molded round non-movable cup-holder or an integral molded non-movable plate-holder positioned in a region of an outer end of the armrest;

the back, seat, four legs, first and second armrests, and cup-holder or plate-holder all being an integral single molded piece;

each seat portion of each chair being contoured downwardly forming a seat depression;

each chair being shaped and dimensioned so that the chairs can be stacked on top of one another in nested fashion; and if the at least one armrest has the cup-holder, the cup-holder being located at an end of the at least one armrest and outwardly of an upper portion of a respective front leg of said four legs joining to the armrest at the end of the armrest and wherein the upper portion has an angled smoothly rounded concave cross-section, and wherein said smoothly rounded concave cross-section substantially conforms to a portion of an outer diameter of the round cup-holder, or if the at least one armrest has the plate-holder, the plate-holder being located at an end of the at least one armrest and outwardly of an upper portion of a respective front leg of said four legs joining to the armrest at the end of the armrest and wherein the upper portion has an angled smoothly rounded concave cross-section, and wherein said smoothly rounded concave cross-section substantially conforms to a portion of an outer diameter of a round portion of the plate-holder.

23. A stackable chair system, comprising:

a plurality of chairs, each chair having a back, a seat, and two armrests all integral with one another in an injection-molded thermal plastic construction;

at least one of the armrests of each chair having an integral molded round cup-holder for accommodating a cup and is at least 2 inches in depth and positioned such that a central vertical axis of the cup lies at least ½ inch outwardly of a longitudinal center line of the at least one armrest;

each seat being contoured downwardly forming a seat depression;

each chair being dimensioned so that the chairs can be stacked on top of one another in nested fashion such that rear legs pass through a gap between the respective armrest and a respective outer lateral edge of the seat, and wherein a maximum gap between a front of each seat of adjacent chairs when stacked is no greater than four inches; and the cup-holder being located at an end of the at least one armrest and outwardly of an upper portion of a respective front leg joining to the armrest at the end of the armrest and wherein the upper portion has an angled smoothly rounded concave cross-section, and wherein said smoothly rounded concave cross-section substantially conforms to a portion of an outer diameter of the round cup-holder.

24. A stackable chair system, comprising:

a plurality of chairs, each chair having a back, a seat, four legs, and two armrests all integral with one another in an injection-molded thermal plastic construction;

at least one of the armrests of each chair having an integral molded non-movable plate-holder for accommodating a plate, the plate-holder being positioned such that a central vertical axis thereof lies at least ½ inch outwardly of a longitudinal center line of the at least one armrest;

the back, seat, four legs, first and second armrests, and plate-holder all being an integral single molded piece;

each seat being contoured downwardly forming a seat depression;

each chair being dimensioned so that the chairs can be stacked on top of one another in nested fashion such that rear legs of said four legs pass through a gap between the respective armrest and a respective outer lateral edge of the seat, and wherein a maximum gap between a front of each seat of adjacent chairs when stacked is no greater than four inches; and the plate-holder being located at an end of the at least one armrest and outwardly of an upper portion of a respective front leg of said four legs joining to the armrest at the end of the armrest and wherein the upper portion has an angled smoothly rounded concave cross-section, said smoothly rounded concave cross-section substantially conforming to a portion of an outer diameter of a round portion of the plate-holder.

* * * * *